United States Patent [19]

Engel

[11] Patent Number: 5,062,029

[45] Date of Patent: Oct. 29, 1991

[54] ADJUSTABLE SPOTLIGHT

[76] Inventor: Hartmut S. Engel, Schloss Heutingsheim, Freiberg am Neckar, Fed. Rep. of Germany, 7141

[21] Appl. No.: 523,621

[22] Filed: May 15, 1990

[30] Foreign Application Priority Data

May 19, 1989 [DE] Fed. Rep. of Germany ..... 3916308

[51] Int. Cl.[5] ..... F21Y 21/26

[52] U.S. Cl. ..... 362/287; 362/401; 362/427

[58] Field of Search ..... 362/269, 271, 272, 273, 362/274, 287, 401, 427, 428, 288, 418

[56] References Cited

U.S. PATENT DOCUMENTS

| | | | |
|---|---|---|---|
| 2,488,898 | 11/1949 | Brasty | 362/427 |
| 3,789,213 | 1/1974 | Sonneman | 362/401 |
| 4,347,557 | 8/1982 | Warshawsky | 362/427 |
| 4,554,620 | 11/1985 | Warshawsky | 362/427 |

FOREIGN PATENT DOCUMENTS

| | | | |
|---|---|---|---|
| 1434644 | 12/1968 | Fed. Rep. of Germany | 362/427 |
| 1250217 | 11/1960 | France | 362/427 |
| 1299974 | 6/1962 | France | 362/428 |
| 911784 | 11/1962 | United Kingdom | 362/427 |

*Primary Examiner*—Ira S. Lazarus
*Assistant Examiner*—Richard R. Cole
*Attorney, Agent, or Firm*—Townsend and Townsend

[57] ABSTRACT

A spotlight is described which has a bar-like carrier part which is subdivided via a separating plane into a fixed base part and a pivotal part which is hinged to this base part via a pivotal hinge and which simultaneously forms the carrier for the respective lighting means. The pivotal hinge is arranged eccentrically with respect to the bar axis and a weight compensation is in particular provided between the pivotal part and the lighting means so that a pivotal movement can be effected with a small positioning force.

24 Claims, 6 Drawing Sheets

Figure 1:
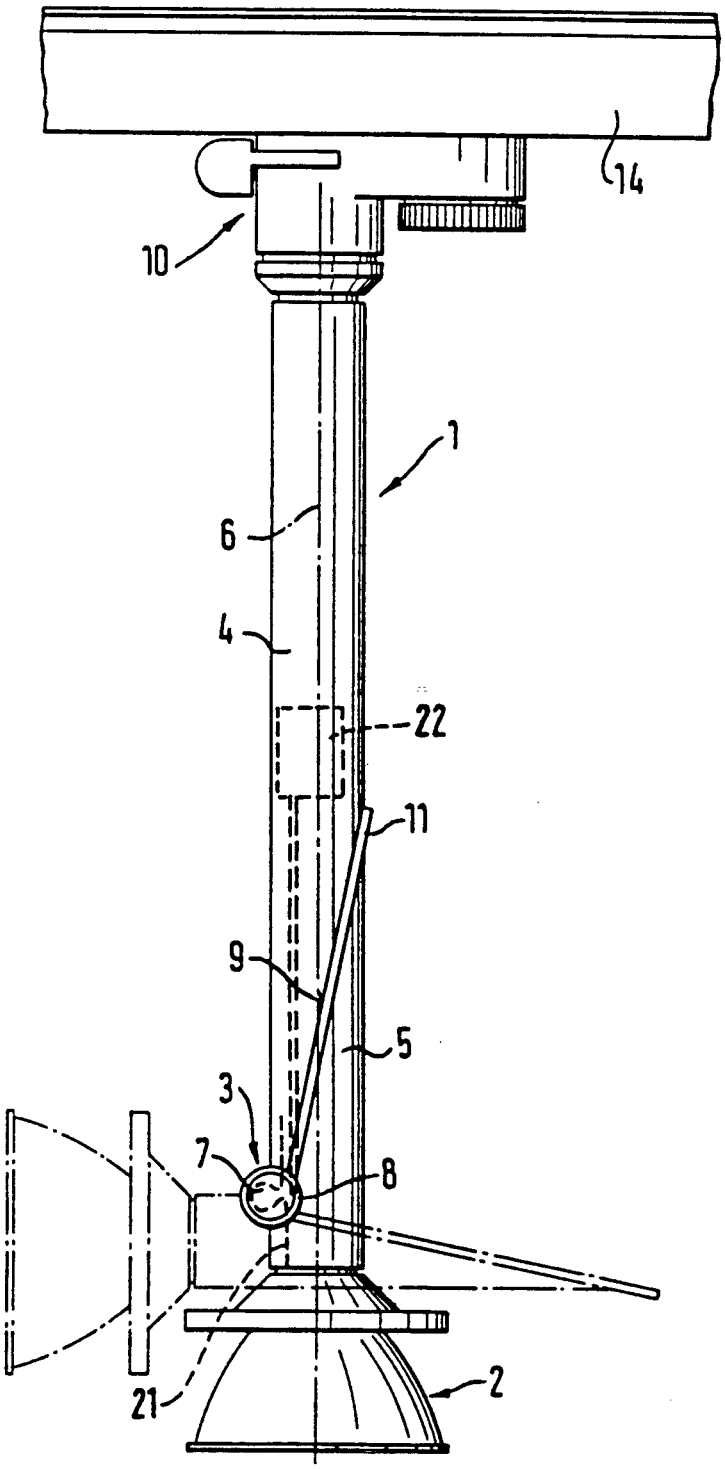

Fig. 6
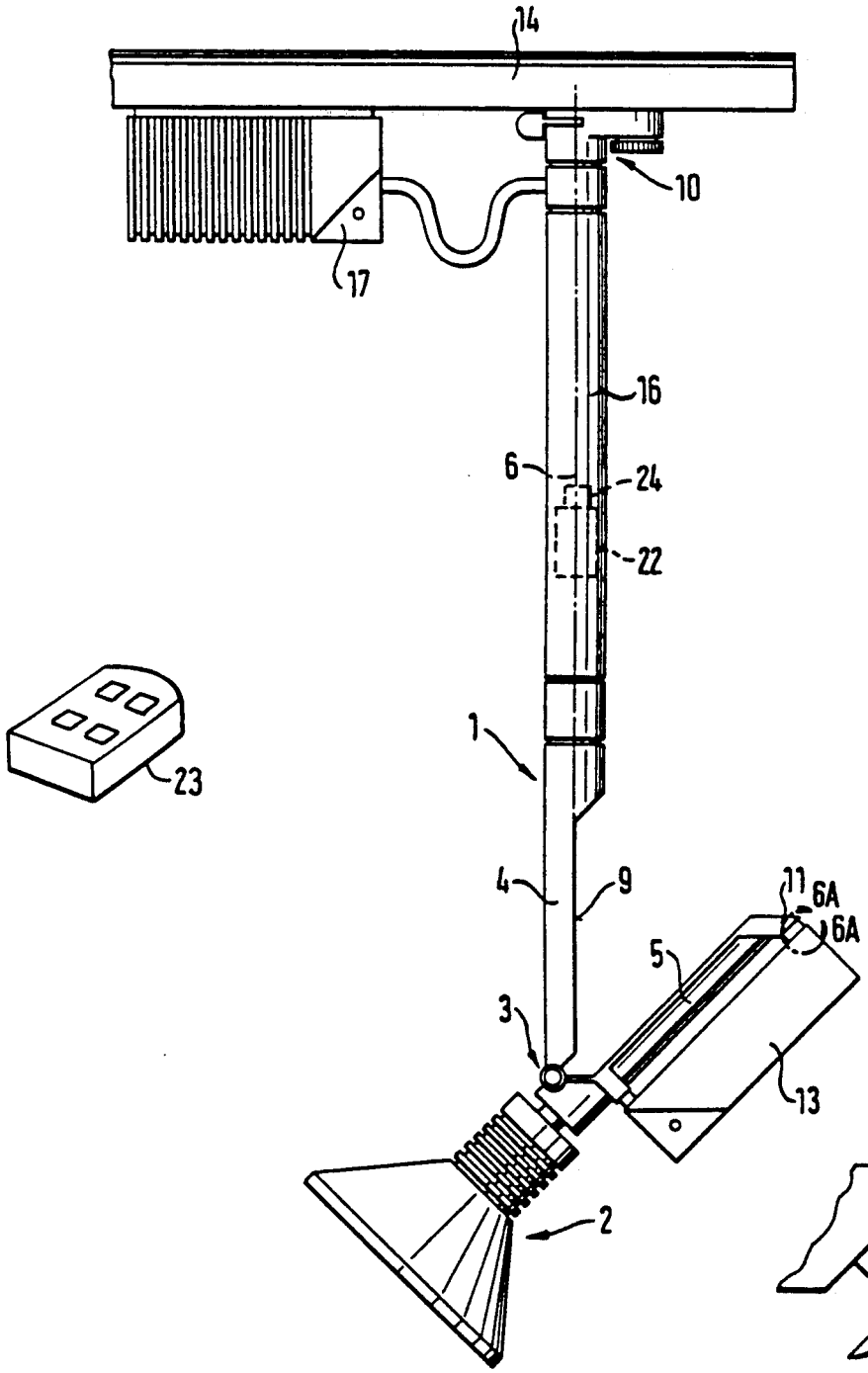
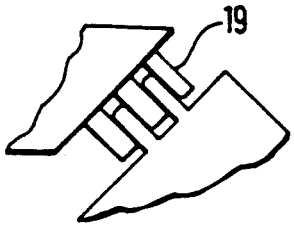
Fig. 6A.

ADJUSTABLE SPOTLIGHT

The invention relates to a spotlight having a carrier part which has a mechanical-electrical unit at one end and is connected at the other end with a lighting part via a pivotal hinge.

Spotlights of diverse forms and for use with the most diverse lighting means are in practical use in large numbers both commercially and also in the private sphere. The respective spotlight designs are customarily matched both from the technical point of view and from the point of view of their shape to the respectively used lighting means and are only suitable for certain lighting means. It is in many cases disturbing that the spotlights are comparatively voluminous and that their variability leaves much to be desired with respect to their adaptability to different lighting tasks.

The object underlying the invention is to develop a spotlight of the initially named kind so that while retaining a unitary basic structure it is on the one hand possible, to use different lighting means and, on the other hand, to obtain the largest possible degree of variability with respect to the lighting tasks which arise in practice.

This object is satisfied in accordance with the invention in that the carrier part is of essentially bar-like form and is subdivided over at least a part of its length into a base part which is connected with the fixed element of the pivotal hinge and a pivotal part which at least carries the lighting part and which is connected with the movable element of the pivotal hinge; and in that the pivotal hinge is eccentrically arranged relative to the bar axis.

The bar-like basic structure and the separation of this basic structure into a base part and a pivotal part via an obliquely extending separating plane results, via the eccentrically disposed pivotal axis, in a high variability in the possibilities of directing the lighting means on the one hand, and in the use of different lighting means, on the other hand, since the pivotal part which likewise has a bar-like basic shape can be formed at its free end to receive all kinds of lighting means without any change of the basic structure.

In addition to the optical and aesthetic balance or appearance of the basic structure comes the fact that the particular lighting means and the base part can be balanced from the point of view of their weight, so that an uncomplicated and balanced adjustment of the inclination of the particular lighting means can take place via the pivotal hinge which must be correspondingly constructed.

Through the choice of the run of the separating plane between the base part and the pivotal part it is possible to achieve both a balance weightwise which is favourable from technical point of view and also an ideal distribution from an aesthetic point of view, between the area of the lighting means and the pivotal part.

In accordance with an advantageous layout of the invention the pivotal part is simultaneously used as a carrier part for elements which have an electrical function, such as for example a power supply or a starter device. Through exploitation of the free space available in this area it is possible to select a shape for these elements having an electrical function which is matched to the graceful bar structure and which has a favourable effect on the weightwise balance of the total pivotal part related to the pivot axis.

A controllable adjustment is provided in accordance with a further development of the invention between the base part and the pivotal part, so that remote control of the direction of radiation of the spotlight can also be realised in a simple manner. The adjustment device can for example comprise a memory metal or be realised via a small motor which is accommodated in the bar structure. It is favourable for all these possible adjustment devices that only very low forces are required for the purpose of the adjustment since the most extensive weight ballance can be realised relative to the pivot hinge as a result of the design.

Ideal thermal decoupling can also be achieved via the bar structure and optionally via reductions in cross-section provided in this structure, in particular between the lighting means and the pivot hinge.

The spotlights formed in accordance with the invention can be used both with standardized light rails via corresponding adapters and also with other kinds of rails via corresponding fitting units and are furthermore naturally also suitable for direct installation. Both low voltage spotlights and also directly fed spotlights as well as practically all further special lamps which are available can be used as the lighting means.

Particularly advantageous layouts of the invention are set forth in the subordinate claims.

Figure 2:
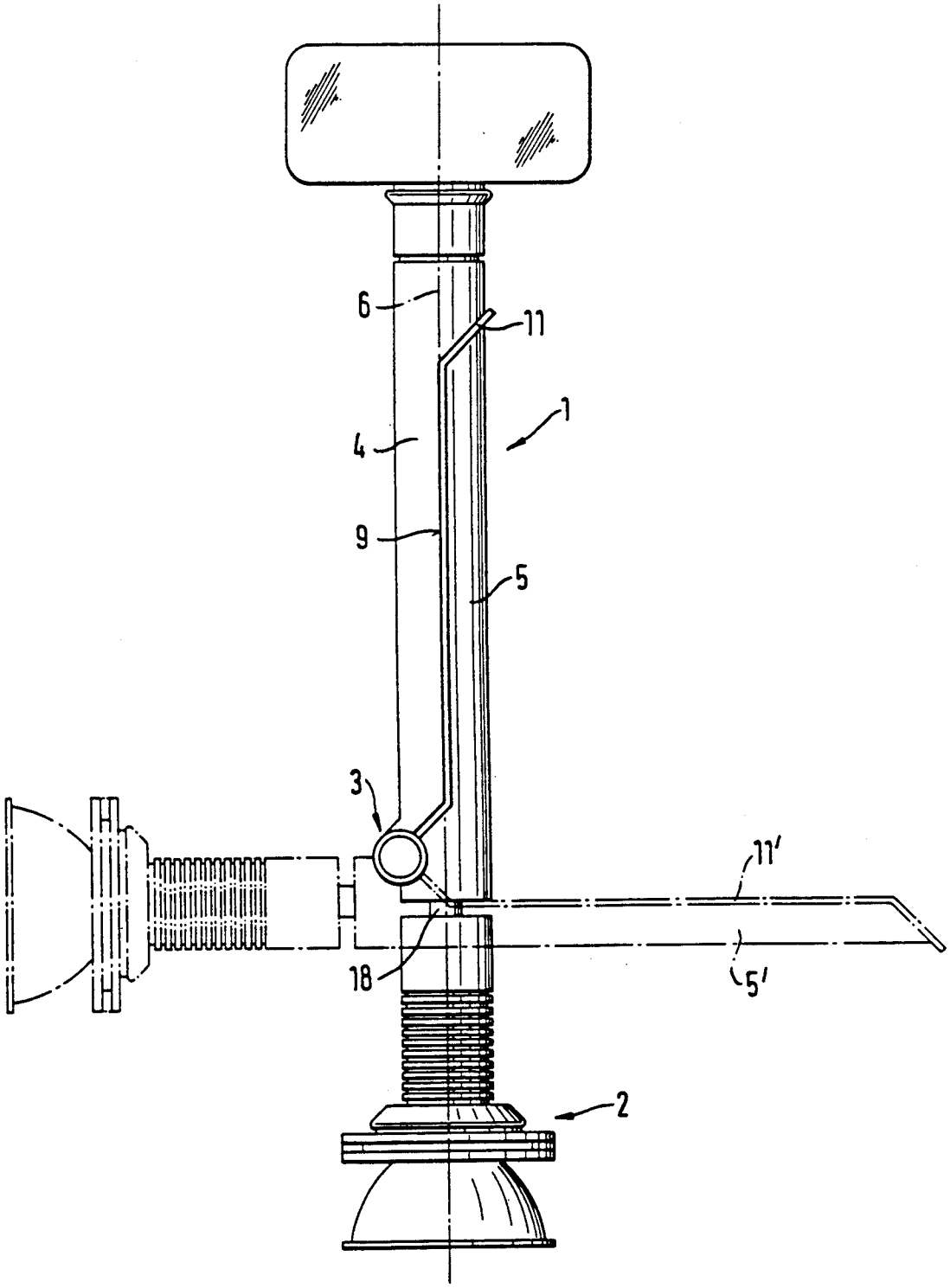
Figure 3:
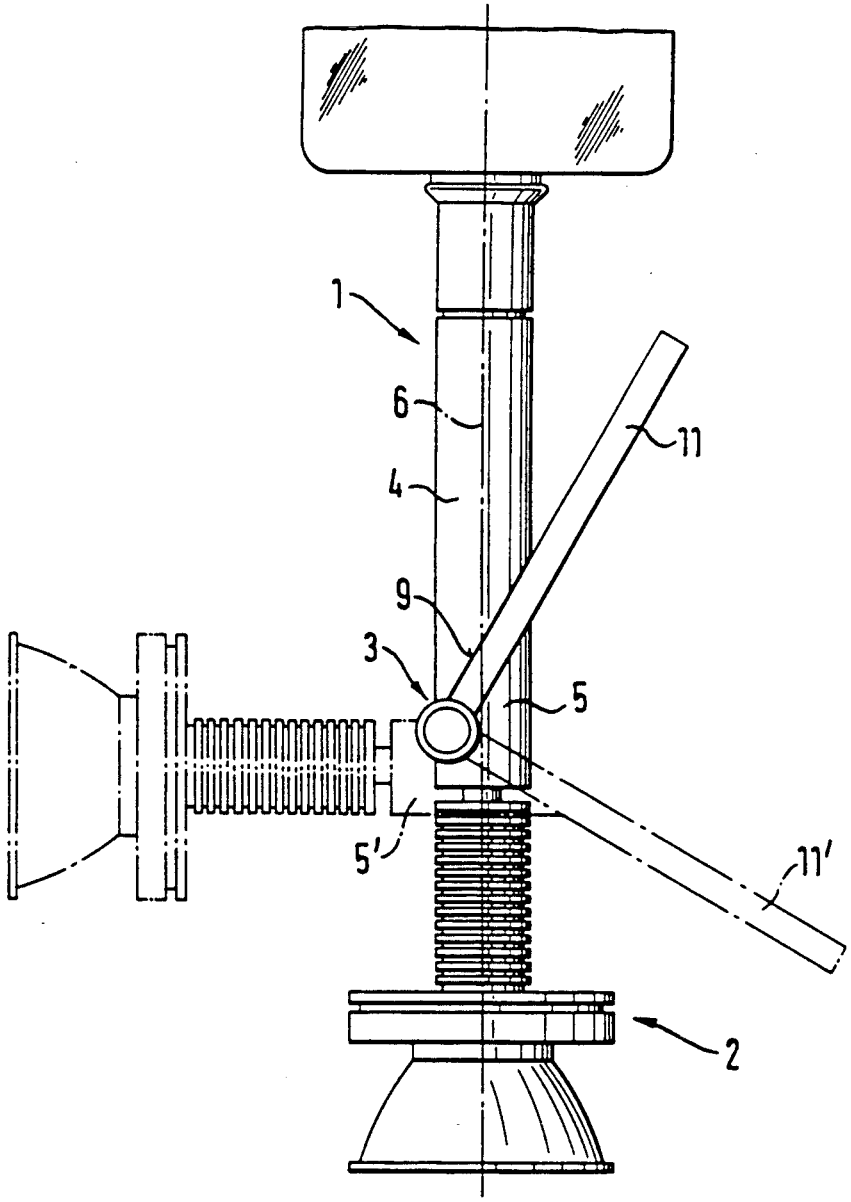
Figure 4:
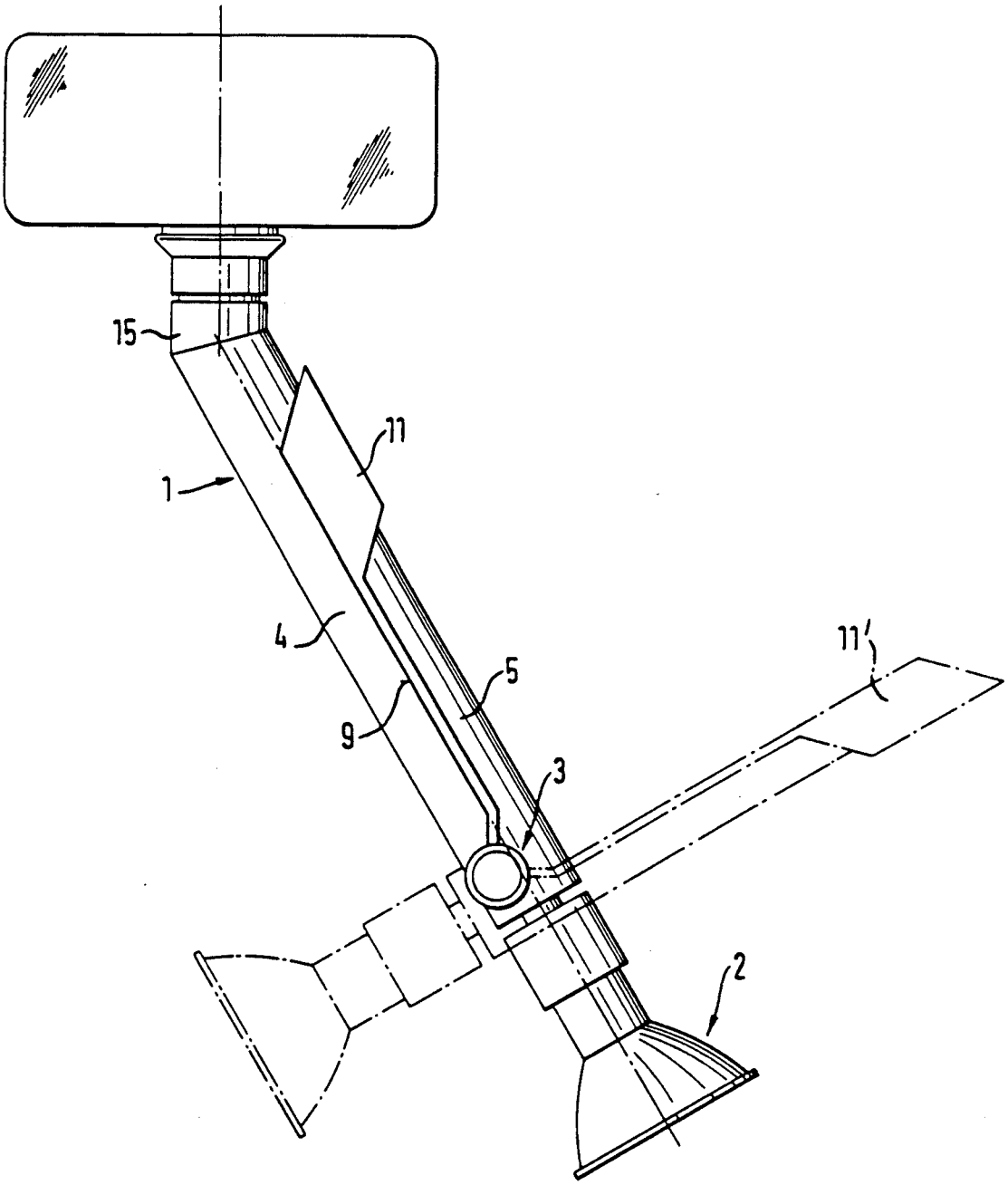
Figure 5:
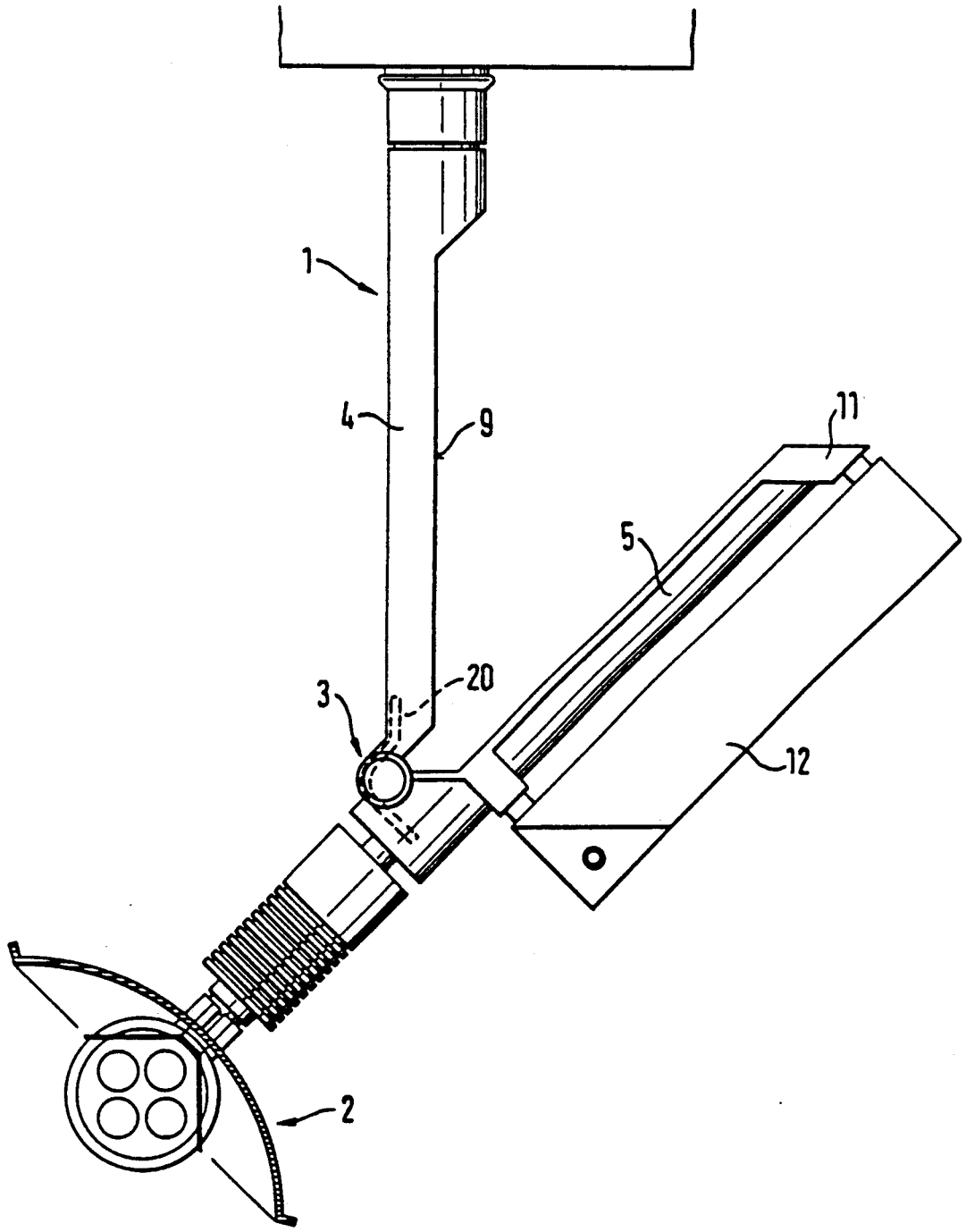

The invention will now be described in the following with reference to embodiments and to the drawing; in the drawing there are shown:

FIG. 1 a schematic side view of a spotlight in accordance with the invention which is secured via an adapter to a standardized light rail, FIG. 2 an embodiment of the spotlight of the invention equipped with a low voltage lighting means, FIG. 3 a variant of the spotlight of FIG. 2 with an adjusting element formed in lever-like manner, FIG. 4 a further variant of the invention with an obliquely extending bar structure, FIG. 5 an embodiment of a spotlight in accordance with the invention with a coupled on power supply, and FIG. 6 a further variant of the invention to explain the variability of the basic structure of the spotlight of the invention.

FIG. 6A a detail of FIG. 6 showing the coupling of the starter or ignition device with the pivotal part.

FIG. 1 shows a customary light rail 14 to which the carrier FIG. 1 part 1 of a spotlight in accordance with the invention is secured, i.e. mechanically and electrically coupled, via an adapter 10. The carrier part 1 which is formed in bar-like manner is subdivided into two parts which are connected to one another via a pivot hinge 3, namely into a fixed base part 4 and a pivotal part 5 which is simultaneously the carrier for the lamp part 2 or for the respectively used lighting means.

The pivotal joint 3 is disposed away from the center relative to the bar axis 6 and the axis of the pivot hinge 3 extends perpendicular to the bar axis 6. The base part 4 is connected to the fixed part 7 of the pivotal hinge 3 and the pivotal part 5 of the bar structure is connected with the movable part 8. The separating plane 9 between the base part 4 and the pivotal part 5 extends at an acute angle to the bar axis 6 and a broadening and/or extension element 11 is provided in the region of this separating plane 9 and projects beyond the circumferential contour of the separating plane.

The axis of the pivotal hinge 3 lies in this embodiment approximately in the region of a generatrix or jacket line of the carrier part 1. I.e. the geometrical axis of the pivotal hinge 3 can be imagined as extending tangential 2 and just touching the surface of the bar-like carrier part 1.

The separating plane 9 is preferably so disposed that the pivotal part 5 forms a compensation weight for the lamp part 2 so that pivoting of the lamp part 2 about the pivot axis 3 is possible with very little force and slight tightness of the hinge 3 ensures a secure fixation of the lamp part in any desired pivotal position within the given pivotal range.

The embodiment of FIG. 2 makes it clear that for the same basic structure it is not only possible to use other lighting means without difficulty but also that the separating plane 9 can be differently designed and can extend over almost the whole length of the carrier part 1. The separating plane 9 expediently extends over a larger range in accordance with, i.e. along the bar axis 6 so that short oblique sections of the separating plane, which preferably extend at the same angle relative to the bar axis can complete the total separating plane. In FIG. 2 the position pivoted through 90° clarifies the weight compensation which can be achieved between the lighting means 2 and the pivotal part 5' with the associated broadening element 11' which forms the counter-weight in this position.

A desirable thermal decoupling can be achieved via a reduction in cross-section 18 between the pivotal part 5 and the lighting means 2.

The embodiment of FIG. 3 makes it clear that even when using a comparatively short separating plane 9 the counter-weight for the respective lighting means 2, which is important both from technical and aesthetic points of view, can be achieved without departing from the graceful basic structure of the spotlight by the use of an extension element in bar or flat bar form.

FIG. 4 shows an embodiment of the invention in which the bar structure of the carrier part 1 can be provided with an angled region 15 by means of a molded on additional part, or an additional part which can be coupled in place, so that an oblique structure of the spotlight arises which extends at a predeterminable angle relative to the mounting point or current rail. This oblique structure of the spotlight is of particular advantage for certain lighting tasks as a result of the pivot angle which can be thereby achieved.

FIG. 5 shows a variant which demonstrates the variability achievable with respect to the use of different lighting means and simultaneously shows that the pivotal part 5 can be particularly favourably used for certain embodiments as a carrier for the parts having an electrical function.

In the illustrated embodiment an energy saving lamp is used as the lighting means and requires the use of a power supply 12. This power supply can be made in the shape of a shallow parallelopiped and is preferably mechanically and electrically connected with the pivotal part 5 via plug couplings.

The variant of FIG. 5 also makes it clear that variability exists in the context of the invention with regard to the positioning of the pivotal hinge which permits an adaptation to the respectively prevailing circumstances but which does not however fundamentally change the basic structure of the spotlight.

FIG. 6 finally shows an embodiment of the invention which makes it clear that the carrier part 1 can be supplemented by bar-like extensions 16, with these extension parts not necessarily having to be straight. If, for example, a fluorescent lamp ballast or choke 17 is directly coupled to the current rail 14 then the spotlight can be connected with this lamp ballast 17 via an electrical cable and for example a starter or ignition device 13 can be coupled with the pivotal part 5 and electrically connected to the letter by means of a plug coupling 19 so that the starter is disposed as close as possible to the associated lamp. It is of particular advantage to effect the pivoting of the light means, which is possible at least in a range of 90 , via a remotely controllable adjustment device since access to the spotlights is frequently difficult and different lighting directions must nevertheless be realised from time to time. For this purpose , as shown in FIG. 5, a member 20 made of a memory metal is preferably arranged in the pivotal part in such a way that on energising the memory metal with a current of defined strength a pivoting of the lighting means takes place which is above all possible without problem because this pivotal movement only requires low positioning forces, and indeed as a result of the balance between the lighting means and the pivotal part 5 with respect to the pivotal hinge 3. The design can be selected such that a pivoting of the spotlight takes place in the direction of increasing the angle between the base part 4 and the pivotal part 5 as a result of the action of gravity, with the resetting being effected via the memory metal. An auxiliary spring 21 shown in FIG. 1, can however also be used in corresponding manner. Finally it is also possible to realise the adjustment via a small motor shown in FIGS. 1 and 6, integrated into the bar structure of the carrier part 1, or in its bar-like extension 16. Of importance in all cases of controlled pivoting of the spotlight is the small positioning force which is required as a consequence of the parts on both sides of the pivotal axis 3 which are balanced weightwise.

The integration of a remote control device, in particular a infrared remote control unit comprising a conventional transmitter 23 and a receiver 24 associated with the motor 22, as shown in FIG. 6, does not cause any difficulties and can be realised with conventional means.

What is claimed:

1. A spotlight having a carrier part which has a mechanical-electrical connection unit at one end and which is connected at the other end with a lighting part via a pivotal hanger, wherein the carrier part is of an essentially bar-like form and comprises a base part, which is connected with a fixed element of the pivotal hinge, and a pivotal part which at least, for carrying the lighting part, having an extension forming, in relation to the pivotal hinge, a counterweight for the lighting part, the pivotal part being connected with a movable element of the pivotal hinge; the pivotal hinge being eccentrically arranged relative to the longitudinal axis of the carrier part.

2. A spotlight in accordance with claim 1, a separating plane extends between the base part and the pivotal part and parallel to the pivotal hinge axis.

3. A spotlight in accordance with claim 2, wherein the separating plane comprises a central region which extends in accordance with the longitudinal axis of the carrier part and is adjoined by an oblique portion which is shorter than the central region, with the oblique portion preferably extending at an angle of approximately 45° to the longitudinal axis of the carrier part.

4. A spotlight in accordance with claim 2, wherein the separating plane extends at an acute angle to the longitudinal axis of the carrier part.

5. A spotlight in accordance with claim 1, wherein the pivotal part is provided with an extension element which extends in correspondence with the separating plane and projects at least regionally beyond the peripheral contour of the separating plane.

6. A spotlight in accordance with claim 1, wherein the center of the pivotal hinge is disposed in the region between a generatrix of the carrier part and a plane positioned about halfway between the generatrix and the longitudinal axis of the carrier.

7. A spotlight in accordance with claim 1, wherein the base part is of angled shape at the mechanical-electrical connection end.

8. A spotlight in accordance with claim 1, wherein the base part is coupled with similar parts or with angled parts for extension or change of direction purposes.

9. A spotlight in accordance with claim 1, further comprising a power supply is held on the pivotal part.

10. A spotlight in accordance with claim 9, wherein the power supply is formed as a shallow parallelopiped.

11. A spotlight in accordance with claim 9, further comprising an ignition device.

12. A spotlight in accordance with claims 9 or 11, wherein the power supply or ignition device is coupable with the pivotal part via plug connectors.

13. A spotlight in accordance with claim 1, further comprising a controllable adjustment device or drive motor provided between the base part and the pivotal part.

14. A spotlight is accordance with claim 13, wherein the adjustment device comprises a memory metal.

15. A spotlight in accordance with claim 13, further comprising an auxiliary spring arrangement, which acts against the adjustment device or drive motor, provided between the base part and the pivotal part.

16. A spotlight in accordance with claim 13, wherein the drive motor is accommodated in the carrier part or in an extension part which can be coupled with the carrier part.

17. A spotlight in accordance with claim 13, wherein the adjustment device can be actuated via a remote control device.

18. A spotlight having a carrier part which has a mechanical electrical connection unit at one end and which is connected at the other end with a lighting part via a pivotal hinge eccentrically arranged relative to the longitudinal axis of the carrier part, wherein the carrier part is of an essentially bar-like form and is of an angled shape at the mechanical electrical connection end, the carrier part comprising a base part and a pivotal part, the base part being connected with a fixed element of the pivotal hinge and the pivotal part being adapted for carrying the lighting part and connected with a movable element of the pivotal hinge.

19. A spotlight in accordance with claim 18, wherein the power supply is formed as a shallow parallelopiped.

20. A spotlight having a carrier part which has a mechanical electrical connection unit at one end and which is connected at the other end with a lighting part via a pivotal hinge eccentrically arranged relative to the longitudinal axis of the carrier part, wherein the carrier part is of an essentially bar-like form and comprises a base part and a pivotal part, the base part being connected with a fixed element of the pivotal hinge and the pivotal part being adapted for carrying the lighting part and a power supply or an ignition device, the pivotal part being connected with a movable element of the pivotal hinge.

21. A spotlight in accordance with claim 20, wherein the power supply or ignition device is coupable with the pivotal part via plug connections.

22. A spotlight having a carrier part which has a mechanical electrical connection unit at one end and which is connected at the other end with a lighting part via a pivotal hinge eccentrically arranged relative to the longitudinal axis of the part, wherein the carrier part is of an essentially bar-like form and comprises a base part, a pivotal part, and a controllable adjustment device, having a memory metal, positioned between the base part and the pivotal pat, the base part being connected with a fixed element of the pivotal hinge and the pivotal part being adapted for carrying the lighting part and being connected with a movable element of the pivotal hinge.

23. A spotlight in accordance with claim 22, wherein the adjustment device is actuated via a remote control device.

24. A spotlight in accordance with claim 23, wherein the remote control device is an infrared remote control device.

* * * * *